US005450838A

United States Patent [19]

Nakahigashi et al.

[11] Patent Number: 5,450,838

[45] Date of Patent: Sep. 19, 1995

[54] GUN BARREL WITH MEANS FOR INSURING CONSISTENT PROJECTILE ROTATION OF A DISCHARGED PROJECTILE

[76] Inventors: Masayuki Nakahigashi, Ibaragi; Masamichi Ohnishi, Osaka, both of Japan

[21] Appl. No.: 75,237

[22] Filed: Jun. 14, 1993

[30] Foreign Application Priority Data

Jun. 13, 1992 [JP] Japan ..... 4-195818

[51] Int. Cl.[6] ..... F41B 11/00

[52] U.S. Cl. ..... 124/56; 124/81

[58] Field of Search ..... 124/56–61, 124/73, 74, 76, 81, 83–85, 70, 71, 72, 75, 77

[56] References Cited

U.S. PATENT DOCUMENTS

| | | | |
|---|---|---|---|
| 3,521,616 | 7/1970 | Chang et al. | 124/81 X |
| 4,002,336 | 1/1977 | Beaver et al. | 124/81 X |
| 4,250,862 | 2/1981 | Speer | 124/83 X |
| 4,674,470 | 6/1987 | Tsukiji | 124/74 |
| 5,063,905 | 11/1991 | Farrell | 124/76 X |

FOREIGN PATENT DOCUMENTS

| | | | |
|---|---|---|---|
| 285798 | 11/1989 | Japan | 124/72 |

*Primary Examiner*—Randolph A. Reese
*Assistant Examiner*—Harry C. Kim
*Attorney, Agent, or Firm*—Edwin E. Greigg; Ronald E. Greigg

[57] ABSTRACT

The invention provides a device for controlling a ball-shaped projectile's trajectory by propelling the projectile at an angle to the gravitational force upon discharge from a barrel including an O-ring. The barrel has a center axis directly and fully offset relative to and above the shared center axis of a chamber and O-ring located at one end of the barrel. Upon firing, the projectile spins directly up a small bevel on the lower inner edge of the chamber-end of the barrel, thus being projected diagonally into the barrel, the bore large enough to provide clearance between it and the projectile. The projectile has consistent and unimpeded rotational acceleration through the upper portion of the barrel which is ensured by air pressure escaping around the projectile and, via the bevel, along the lower surface of the barrel.

6 Claims, 3 Drawing Sheets

GUN BARREL WITH MEANS FOR INSURING CONSISTENT PROJECTILE ROTATION OF A DISCHARGED PROJECTILE

BACKGROUND OF THE INVENTION

1. Field of the Invention

As detailed below, this air gun discharge method and apparatus is an invention which addresses the problem of how to increase the projectile range and precision in gas pressure air guns that fire ball-shaped projectiles-for example, as a discharge method and apparatus for guns that fire paint-filled balls.

2. Prior Art

Legal restrictions on $CO^2$ or compressed air discharge pressure levels limit the range and accuracy of air guns. Various designs to improve air gun performance have thus been proposed. For example, Japanese Patent No. 61-173099 (Tsukiji) proposes a discharge apparatus that will be described next with reference to FIG. 4.

A projectile 5 is supplied to chamber 1 via aperture 2 and forwarded to and held in place by O-ring 4 during the firing process. At the same time, pressure gas is introduced to chamber 1, which pushes forward projectile 5 and O-ring 4 such that projectile 5 is discharged into barrel 3. However, the projectile is discharged without rotation and, therefore, under the pressure limitations of pressure gas, no improvements in range or precisions are realized.

Recently, it has been proposed that rotation be given to a projectile to improve air gun performance. Japanese Patent No. 3-35997 (Morioka) discloses a means for placing counter-gravitational spin on a ball-shaped projectile. This known prior art uses an irregularly shaped elastic cylinder to seat a ball projectile, with a peg-like protuberance set above the cylinder and extending downwards; upon discharge, the ball hits the bolt causing the projectile to spin in an upward direction vertical and opposite to the gravitational force. In this known prior art, the upper portion of the flexible cylinder is squeezed between the tip of the bolt and the projectile, making the cylinder susceptible to tearing due to the stress of discharge. Moreover, the obstructive bolt and the air pressure that escapes out the chamber through the irregular elastic cylinder combine to create an unstable trajectory and only minor improvements in projectile performance.

SUMMARY OF THE INVENTION

In view of the conditions and characteristics of low powered air guns and the disadvantages of prior art as discussed above, the main object of the present invention is to increase shooting range as well as to maintain accuracy in such guns, while not necessitating impractical or restrictive structural changes or wear on parts. Thus this invention offers the potential for increased projectile distance, speed, and accuracy, and efficient production costs. The efficient and effective results of the invention have been proven in Japan under Japanese Patent No. 195819. Japan has strict limitations on projectile size, density, and firing-power of model or toy guns; the invention is in wide use in Japan in gun toys that fire small, hard plastic balls.

In the present invention, a relatively friction-free yet bouyant and rotational projectile flight is attained by the unique functioning of the gun assembly. The projectile rotates counter to gravity throughout its flight and is kept in a relatively stable rotational path due to constant air flow around the projectile and along the lower part of the barrel. Air pressure escapes into the barrel from the bevel and along the clearance caused by the relatively larger barrel bore, both factors providing a relatively unimpeded forward acceleration and upward lift as the projectile rolls along the upper part of the barrel. Therefore, inventive goals are met by employing a bevel formed on the lower inner peripheral edge of the chamber-end of a barrel, a clearance between the barrel and projectile, and barrel center axis being directly offset above the center axis of a chamber and O-ring. Either the end of the barrel facing the chamber or the O-ring-end of the chamber itself is formed such that it has an indented or cut upper exterior portion, preferrably eccentric, resulting in a higher center axis of the barrel relative to the center axis of the chamber and O-ring when the two axes intersect.

Gas or pressurized air are the recommended methods of projectile discharge. Single to automatic projectile discharge designs are possible. Any kind of O-ring made of rubber may be used, as well as its equivalent such as an elastic or flexible cylinder or tube. Any plastic-type material may be used in projectile composition, such as the plaint shell material of a paint-filled ball.

In the conventional and prior art, the connection between the center axes of the chamber and barrel are kept true in order to secure a straight trajectory of a projectile. The present invention's relative shift of the center axes of barrel and chamber/O-ring, at the point of projectile discharge, is thus new and also effective in keeping a projectile flight straight as well as in making a projectile fly much farther. This uniform offset works in concert with a bevel on the lower inner edge of the barrel end to minimize friction, which is excessive in the prior art, and to assure straight and accurate projectile flight.

The novel features of this invention are detailed in the claims as written below. The following description and illustrations, having correlating numbers and letters, specify the organization and functioning of the invention.

BRIEF DESCRIPTION OF THE DRAWINGS

The drawings show an embodiment of an air gun according to the present invention in which.

DETAILED DESCRIPTION OF THE PREFERRED EMBODIMENT

Figure 1:
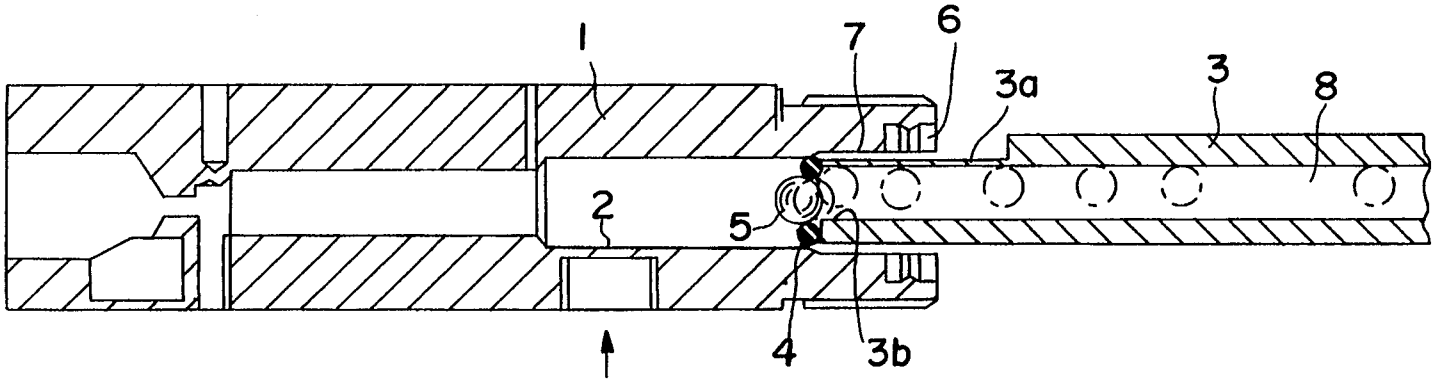
FIG. 1 is a partial cross-sectional view of the essential portion of an embodiment of an air gun illustrating the present invention.
Figure 2:
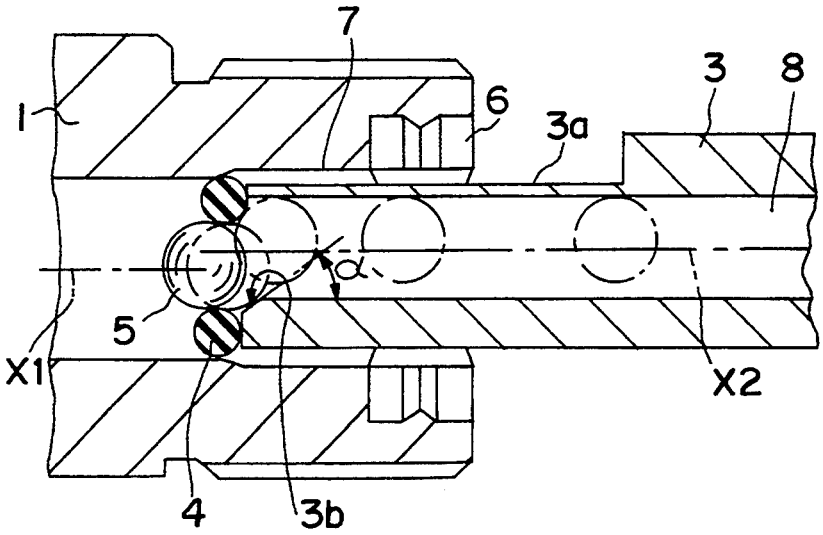
FIG. 2 is an enlarged cross-sectional view of the essential portion of an embodiment of the invention.
Figure 3:
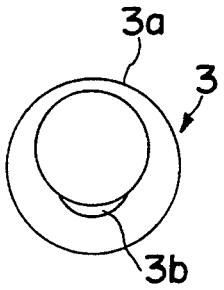
FIG. 3 is an end view of the end portion of a barrel that meets or connects to a chamber.

Referring to FIGS. 1 and 2, an embodiment of an air gun illustrating the present invention is shown (construction of the invention is not limited to these illustrations however), in which a conventional shooting mechanism (for instance, the mechanism of FIG. 4) is arranged such that 1 indicates a chamber, 2 an aperture, 3 a barrel, 4 an O-ring, 5 a ball-shaped projectile, 6 a flange holding barrel and chamber together, 7 a stepped portion of the chamber. Detailed description of the overall functioning of the mechanism is omitted because i is irrelevant.

Figure 4:
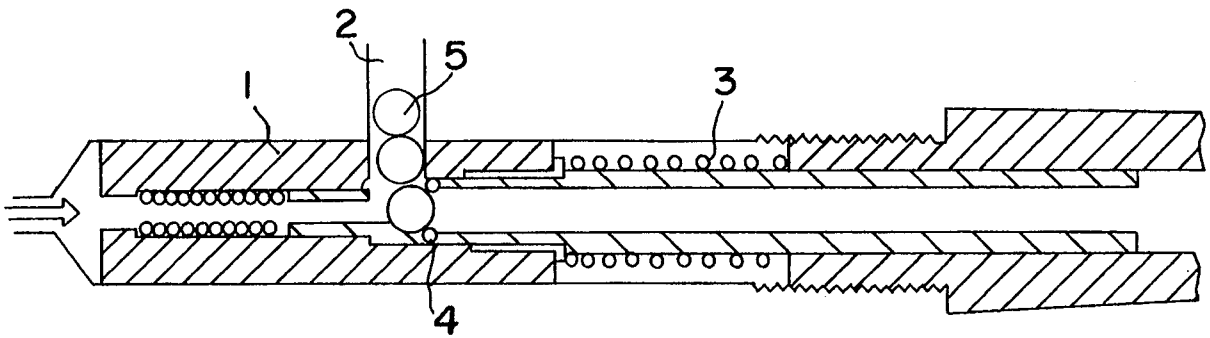
FIG. 4 PRIOR ART
FIG. 4 is a cross-sectional view of a conventional air gun chamber and barrel assembly showing the prior art.

Aperture 2 feeds projectile 5 into chamber 1. For purposes of illustration but not limitation, projectile 5 is given here as being made of hard plastic and being 6 mm in diameter. Projectile 5 in chamber 1, supplied via aperture 2, is moved by means of the conventional shooting mechanism to a position within O-ring 4 at a point just before stepped portion 7 when gun action is engaged prior to discharge of projectile 5 into barrel 3. Barrel 3 and chamber 1 overlap, center axis X1 of chamber 1 is offset at a point lower (in this example, preferrably 0.6 mm to 1.0 mm) than center axis X2 of barrel 3, as shown in FIG. 2. Referring to FIGS. 1 and 2, the shift in axes is obtained by forming an eccentric upper exterior portion 3*a* at the left end of barrel 3, which in this illustration has an outer diameter of 8.6 mm. The end of barrel 3 which has eccentric exterior upper portion 3*a* is held in chamber 1 using flange 6. The outer diameter of barrel 3 (other than upper portion 3*a*) is given here as 10 mm, and bore 8 of barrel 3 as 6.1 mm, the difference or clearance between projectile 5 and bore 8 of barrel 3 being 0.1 mm. This means that a clearance of about 0.1 mm is formed between projectile 5 and the inner bottom surface of barrel 3 when projectile 5 is propelled upwardly into barrel 3 from O-ring 4. Chamber 1, O-ring 4, and the left end of barrel 3 meet just before (to the left of) stepped portion 7 when the shooting mechanism is in motion right before projectile 5 is released into the barrel 3. Chamber pressure in the engaged shooting mechanism forces projectile 5 and O-ring 4 into stepped portion 7 of chamber 1, causing expansion of O-ring 4, resulting in the release of projectile 5 into the barrel 3. As shown in FIGS. 1, 2, and 4, barrel 3 is designed most commonly to move into chamber 1, chamber 1 and barrel 3 are supported in relation to each other by flange 6.

As shown in FIGS. 1, 2, and 3, 3*b* is a beveled or oblong angular surface formed on the inner lower edge of the end of barrel 3 facing chamber 1, the angle of bevel 3*b* radiating in the direction of barrel 3 and preferrably between 30 and 45 degrees. Bevel 3*b* causes the projectile 5 which is seated in O-ring 4 at the center axis X1 to rotate vertically to the center axis X2 of barrel 3 at the point of discharge from O-ring 4; projectile 5 passes through and leaves expanded O-ring 4 and makes contact with bevel 3*b*, being made to slip and then rotate in a counter-clockwise direction around center axis X2 of the horizontal barrel 3 in a cross-sectional view such as that provided by FIG. 2. The size and angle of bevel 3*b* is formed such that projectile 5 makes contact with the bevel 3*b* when the projectile leaves O-ring 4. Bevel 3*b* is formed in relation to the amount of shift between center axis X1 and center axis X2 as well as the diameters of bore 8 and chamber 1.

Upon discharge from O-ring 4, the lower portion of projectile 5 slips against bevel 3*b* and into barrel 3 which has a bore 8 that is large enough to provide a clearance between the barrel 3 and the projectile 5. The shifting of center axis X1 below that of X2, the ramp-like angle of bevel 3*b*, and the larger size of bore 8 relative to projectile 5 act together to cause projectile 5, upon discharge from O-ring 4, to slip against bevel 3*b* and be propelled rotatably upwards into barrel 3 and rotated counter-clockwise along the upper part of barrel 3. Projectile 5 sbouyant rotational trajectory along the upper portion of barrel 3 is accelerated and ensured by the minimal friction of the upper part of barrel 3 and the air pressure escaping at a high speed out of chamber 1 around the undersized projectile 5 and along the lower surface of barrel 3 from bevel site 3*b*.

What is claimed is:

1. A discharging apparatus of an air-gun, in which a ball bullet of plastics is discharged under gas pressure, comprising:
   - a barrel having a cut surface formed on an inner peripheral edge of an inner end of the barrel,
   - a chamber having a center axis, and
   - an O-ring having a center axis and arranged in the chamber coaxial with said center axis of the chamber and said center axes of the O-ring and the chamber are shifted substantially offset with respect to a center axis of the barrel which has one end forced into said chamber and secured thereto.

2. The apparatus of claim 1, wherein a base end of the barrel is cut along its upper portion to form an eccentric base end which shifts the center axis of the barrel relative to the center axes of the chamber and the O-ring.

3. An air gun discharge assembly utilizing gas pressure for projecting a plastic-type ball-shaped projectile, comprising the following improvements:
   - a chamber;
   - an O-ring enclosed in said chamber and juxtaposed to an end of a barrel;
   - said chamber and said O-ring sharing a common center axis;
   - said common center axis of said chamber and said O-ring being offset relative to a center axis of said barrel.

4. A gun assembly as defined in claim 3 comprising:
   - a bevel defined as a small oblong angular surface formed on and radiating into a lower peripheral edge of an inner end of said barrel facing said chamber, due to said offset of the common center axis relative to the center axis of the barrel at a point at which said barrel and said O-ring meet, said ball-shaped projectile is propelled through said chamber through said O-ring and along said barrel, to rotate said projectile counter-clockwise to the center axis of said barrel, as seen in a cross-sectional view of the barrel.

5. A gun assembly as defined in claim 4, in which an upper exterior end portion of said barrel that faces said chamber having a cut-away eccentric surface such that said offset occurs between the center axis of said barrel and the common center axis of said chamber and said O-ring, and the barrel being held in place by a flange on said barrel where said barrel fits into said chamber.

6. A gun assembly as defined in claim 3, in which an upper exterior end portion of said barrel that faces said chamber having a cut-away eccentric surface such that said offset occurs between the center axis of said barrel and the common center axis of said chamber and said O-ring, and the barrel being held in place by a flange on said barrel where said barrel fits into said chamber.

* * * * *

UNITED STATES PATENT AND TRADEMARK OFFICE

CERTIFICATE OF CORRECTION

PATENT NO. : 5,450,838

DATED : September 19, 1995

INVENTOR(S) : Masayuki Nakahigashi et al

It is certified that error appears in the above-identified patent and that said Letters Patent is hereby corrected as shown below:

Col. 1, line 30, change "precisions" to --precision--.

Col. 3, line 2, change "i" to --it--.

Col. 4, line 3, change "5 sbouyant" to --5's bouyant--;

line 51, change "having" to --has--;

line 58, change "having" to --has--.

Signed and Sealed this

Twenty-first Day of May, 1996

Bruce Lehman

*Attest:*

BRUCE LEHMAN

*Attesting Officer*

*Commissioner of Patents and Trademarks*